US005596794A

United States Patent [19]

Shibanushi

[11] Patent Number: 5,596,794

[45] Date of Patent: Jan. 28, 1997

[54] PLASTIC SURFACE FASTENER

[75] Inventor: Yoshio Shibanushi, Toyota, Japan

[73] Assignee: Nifco Inc., Yokohama, Japan

[21] Appl. No.: 321,769

[22] Filed: Oct. 12, 1994

[30] Foreign Application Priority Data

Oct. 12, 1993 [JP] Japan ..... 5-277397

[51] Int. Cl.[6] ..... A44B 18/00

[52] U.S. Cl. ..... 24/452; 24/442; 24/447

[58] Field of Search ..... 24/442, 444, 446, 24/447, 448, 449, 450, 452; 248/205.2; 128/DIG. 15

[56] References Cited

U.S. PATENT DOCUMENTS

| | | | |
|---|---|---|---|
| 3,266,113 | 8/1966 | Flanagan, Jr. | 24/442 |
| 5,040,275 | 8/1991 | Eckhardt et al. | 24/447 |
| 5,212,853 | 5/1993 | Kaneko | 24/442 |

FOREIGN PATENT DOCUMENTS

| | | | |
|---|---|---|---|
| 2027794 | 2/1980 | United Kingdom | 24/447 |

*Primary Examiner*—Victor N. Sakran

*Attorney, Agent, or Firm*—Oblon, Spivak, McClelland, Maier & Neustadt, P.C.

[57] ABSTRACT

A plastic surface fastener whose surface fastener members can be engaged by a small force includes two surface fastener members each having a plastic base and multiple projecting members having identically sized engagement heads and standing upright on the base as arranged in a matrix of prescribed pitch. The shape of the engaging heads of both surface fastener members as viewed from the top is that obtained by cutting off segments from four sides of a circle, and selected projecting members of one surface fastener member are removed in an appropriate pattern for providing room for the projecting members of the other surface fastener member to escape when the projecting members of the one fastener member are forced into spaces enclosed by the projecting members of the other fastener member.

1 Claim, 3 Drawing Sheets

PLASTIC SURFACE FASTENER

BACKGROUND OF THE INVENTION:

1. Field of the Invention:

This invention relates to a plastic surface fastener consisting of two surface fastener members each comprising a flat plastic base and multiple projecting members having identically sized engagement heads and provided to stand upright on the base, which surface fastener members can be engaged by pressing them on to each other and disengaged by stripping them apart.

2. Description of the Prior Art:

Recent years have seen an increase in the number of applications for press-on-strip-off plastic surface fasteners. Such fasteners have come into wide use in the automotive sector, for example, where they are utilized for such purposes as attaching various passenger compartment finishing materials, preventing head lining sag, and holding down glass members.

A prior art plastic surface fastener of this type is described in U.S. Pat. No. 5,212,853, for example. The surface fastener taught by this patent consists of two surface fastener members each constituted of a plastic base and multiple projecting members having identically sized engagement heads and provided to stand upright on the base. Each of the engaging heads is integrally supported on the associated base by two legs whose distal ends are attached to the engaging head at opposing positions on the periphery of the bottom surface thereof.

As shown in the side view of this prior art surface fastener in FIG. 7(*a*), the surface fastener 1 consists of two surface fastener members A and B of identical structure. Specifically, each surface fastener member has a base 20 and numerous projecting members 21 standing upright on the base 20, and each of the projecting members 21 consists of a hemispherical engaging head 22 and two legs 23 extending perpendicular to the base 20 for integrally connecting the engaging head 22 with the base 20.

Viewed from above, the projecting members 21 are arranged on the base 20 in the form of a matrix of regular pitch. As shown in FIG. 7(*b*), the spacing between adjacent projecting members 21 is such that when a projecting member 21A of one surface fastener member A is forced into the space enclosed by four engaging heads 22B of the other surface fastener member B, the upward facing engaging head 22A of the surface fastener member A is caught by each of the four engaging heads 22B.

For realizing the aforesaid arrangement of the prior art surface fastener, the projecting members 21 have to be arranged densely with their engaging heads 22 nearly in contact with each other in both the surface fastener member A and the surface fastener member B. Therefore, as shown in FIG. 7(*b*), when the engaging heads 22A of projecting members 21A of the surface fastener member A are forced into each of the spaces enclosed by four engaging heads 22B of the other surface fastener member B, the engaging heads 22A and the engaging heads 22B get in each other's way so that the four projecting members 21B of the surface fastener member B have no or only little room to escape outward from the center of the invading projecting members 21A. As a result, a large force is required for pressing the surface fastener into engagement.

An object of this invention is to provide a plastic surface fastener which requires less force to press it into engagement.

SUMMARY OF THE INVENTION

For achieving the aforesaid object, this invention provides for a plastic surface fastener comprising two surface fastener members each having a plastic base and multiple projecting members having identically sized engagement heads and standing upright on the base as arranged in a matrix of prescribed pitch, selected projecting members of one surface fastener member being removed in an appropriate pattern for providing room for the projecting members of the other surface fastener member to escape when the projecting members of said one fastener member are forced into spaces enclosed by the projecting members of said other fastener member.

This invention also provides for a plastic surface fastener comprising two surface fastener members each having a plastic base and multiple projecting members having identically sized engagement heads and standing upright on the base as arranged in a matrix of prescribed pitch, the shape of the engaging heads of both surface fastener members as viewed from the top being that obtained by cutting off segments from four sides of a circle.

The concept of this invention further encompasses a plastic surface fastener in which selected projecting members of one surface fastener member are removed in an appropriate pattern for providing room for the projecting members of the other surface fastener member to escape when the projecting members of said one fastener member are forced into spaces enclosed by the projecting members of said other fastener member and in which the shape of the engaging heads of both surface fastener members as viewed from the top are that obtained by cutting off segments from four sides of a circle.

Since selected projecting members of one of the two surface fastener members used in combination are removed in an appropriate pattern, the spaces formed by the removal of the selected projecting members provides room for the projecting members of the other surface fastener member to escape when the projecting members of said one fastener are forced into spaces enclosed by the projecting members of said other fastener member. As a result, the force required to press the two surface fastener members into engagement is smaller than in the prior art fastener.

In addition, since in both of the two surface fastener members used in combination the shape of the engaging heads as viewed from the top is that obtained by cutting off segments from four sides of a circle, additional room is provided for the projecting members of the other surface fastener member to escape when the projecting members of said one fastener are forced into spaces enclosed by the projecting members of said other fastener member. As a result, the force required to press the two surface fastener members into engagement is smaller than in the prior art fastener.

Moreover, since selected projecting members of one of the two surface fastener members used in combination are removed in an appropriate pattern and, in addition, the shape of the engaging heads as viewed from the top is that obtained by cutting off segments from four sides of a circle, considerable room for escape is provided. As a result, the two surface fastener members can be pressed into engagement more smoothly than in the prior art fastener.

The above and other objects, characteristic features and advantages of this invention will become apparent to those skilled in the art from the description of the invention given hereinbelow with reference to the accompanying drawings.

BRIEF EXPLANATION OF THE DRAWINGS

FIG. 8(*b*) is a diagram for explaining the engaged state of the projecting members of the surface fastener members of FIG. 7(*a*).

DESCRIPTION OF THE PREFERRED EMBODIMENT

Figure 6:
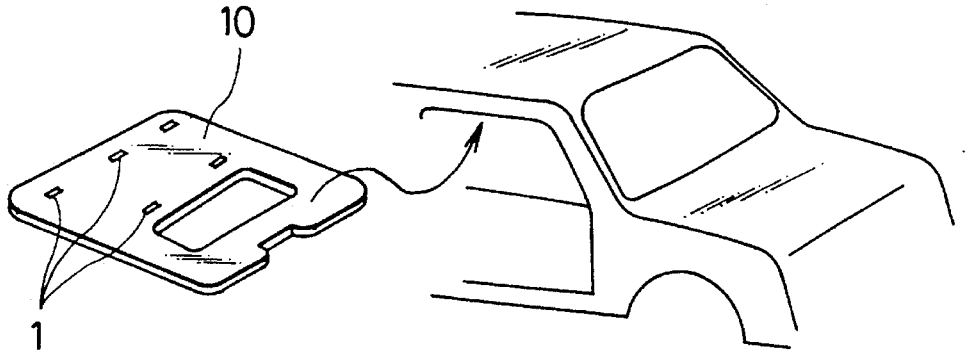
FIG. 6 is a perspective view showing surface fasteners according to this invention in use.
Figure 7A:
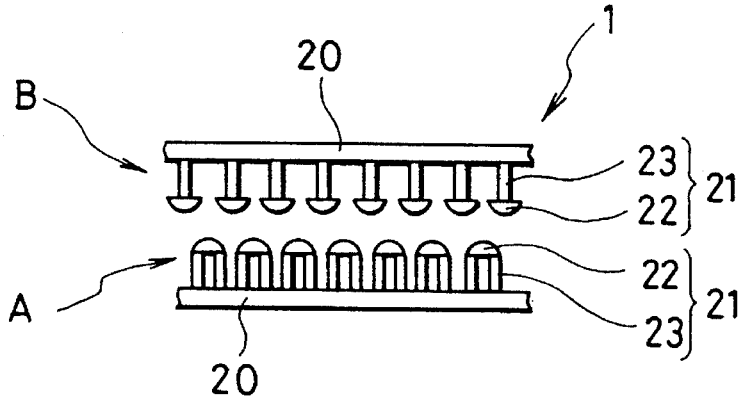
FIG. 7(a) (PRIOR ART)
FIG. 7(*a*) is a side view of a prior art press-on-strip-off plastic fastener.
Figure 7B:
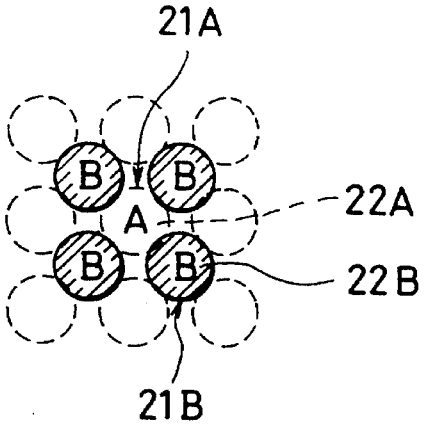
FIG. 7(b) (PRIOR ART)

FIG. 6 shows an example of how the surface fastener according to this invention is used for attaching a ceiling covering material 10 to the ceiling of an automobile. A number of surface fasteners 1 are fixed such that one surface fastening members thereof are positioned at appropriately spaced locations on the inner surface of the ceiling covering material 10 and an equal number of surface fastener members are fixed at corresponding positions on the automobile ceiling. The ceiling covering material 10 can then be attached to the ceiling simply by pressing the surface fastener members on the ceiling covering material 10 into engagement with those on the automobile ceiling.

Figure 1:
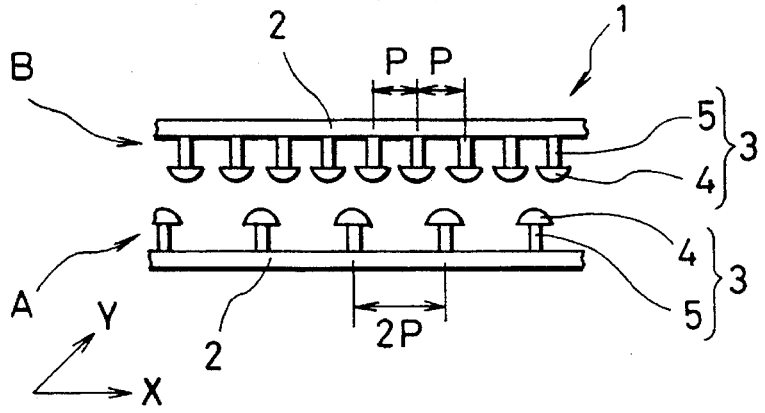
FIG. 1 is a side view of an embodiment of a surface fastener according to an embodiment of the invention.

As shown in FIG. 1, the surface fastener member 1 comprises two surface fastener members A and B which can be engaged by pressing them on to each other and disengaged by stripping them apart. The surface fastener member B consists of a flat plastic base 2 and multiple projecting members 3 standing upright on the plastic base 2 as arranged in a matrix of prescribed pitch P in both the X and Y directions. The projecting members 3 consist of identically sized hemispherical engagement heads 4 and legs 5 that connect the engagement head 4 with the plastic base 2.

The surface fastener member A consists of a flat plastic base 2 and multiple projecting members 3 standing upright on the plastic base 2 as arranged in a matrix of pitch 2P (twice the pitch of the surface fastener member B) in the X direction and pitch P in the Y direction. As in the surface fastener member B, the projecting members 3 consist of identically sized hemispherical engagement heads 4 and legs 5 that connect the engagement head 4 with the plastic base 2. The configuration of the surface fastener member A is thus what is obtained by removing every other projecting member 3 in each X-direction row of the surface fastener member B.

Figure 3:
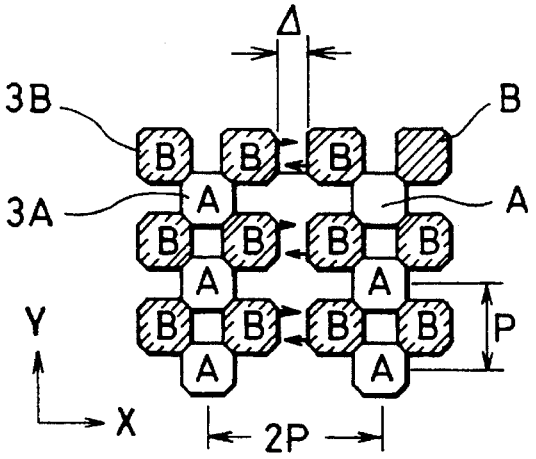
FIG. 3 is a diagram for explaining the engaged state of the projecting members of the surface fastener members of FIG. 1.

The effect of this arrangement is illustrated in FIG. 3. Specifically, when the projecting members 3A of the surface fastener member A are forced into spaces each enclosed by four projecting members 3B of the fastener member B, the four projecting members 3B surrounding each invading projecting member 3A are able to escape in the directions indicated by the arrows because the neighboring space enclosed by four projecting members 3B does not receive a projecting member 3A and remains as a gap Δ. As a result, the surface fastener member A can be pressed into engagement with the surface fastener member B by a smaller force than required with prior art fasteners of this type.

Figure 2:
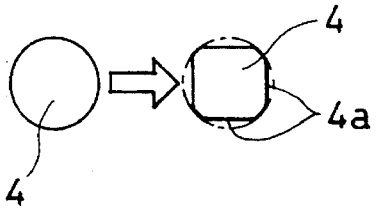
FIG. 2 is a plan view showing the shape of the engaging heads of the projecting members of the surface fastener members of FIG. 1.
Figure 4:
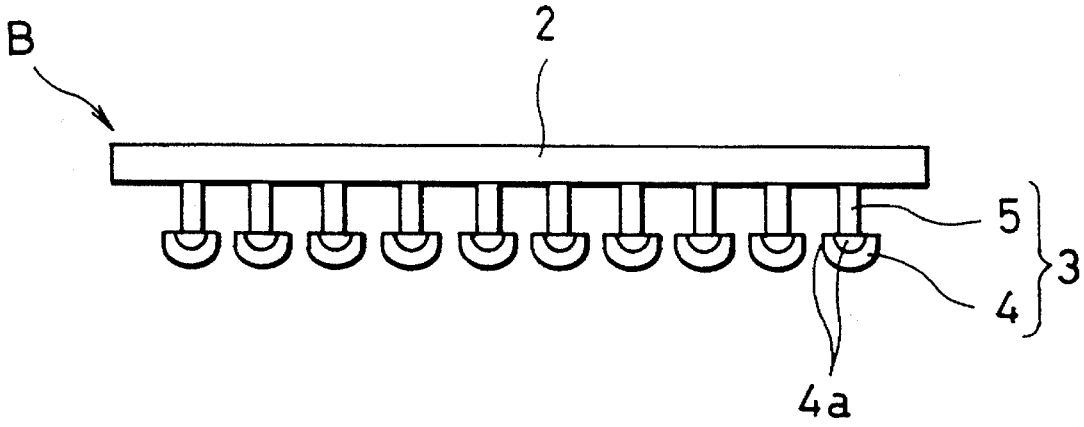
FIG. 4 is an enlarged side view of a surface fastener member according to the invention having a complete set of projecting members.
Figure 5:
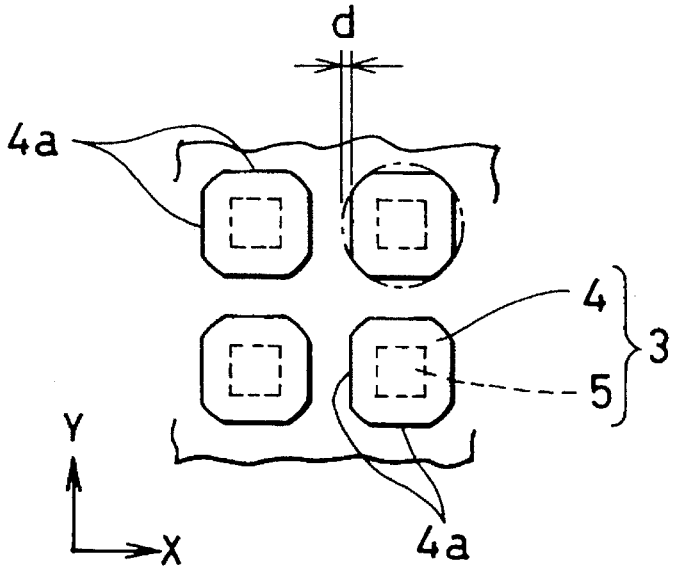
FIG. 5 is an enlarged plan view showing a portion of a surface fastener member according to the invention.

In this embodiment, the engagement heads 4 of the projecting members 3 of the surface fastener members A, B are not of perfectly hemispherical shape but, as shown in FIGS. 2, 4 and 5, the shape of the engaging heads as viewed from the top is that obtained by cutting off segments from four sides of a circle. Thus if the cut-off segments have a thickness in the radial direction of d (see FIG. 5), the distance between adjacent engagement heads 4, 4 aligned in the X and Y directions is increased by 2*d*, whereby the room for escape to the left and right becomes greater than in the case of engagement heads of perfectly hemispherical shape. As a result, even if selected projecting members 3 were not removed from either of the surface fastener members, the engagement between the projecting members 3 of the opposing surface fastener members could still be achieved with less pressing force than in the past owing to the presence of the additional room for escape.

In the illustrated embodiment, the gaps Δ formed by removing selected projecting members 3 in an appropriate pattern so as to leave room for the projecting members 3 to escape is augmented by the additional room for escape (2*d*) obtained by slicing four peripheral regions from the engagement head 4 of each projecting member 3. The gaps Δ and the spaces enlarged by 2*d* produce a synergistic effect that enables the surface fastener to be engaged with ease. The fastener thus considerably facilitates the work of attaching automobile passenger compartment finishing materials.

The dimensions of the engagement head 4 and the leg 5 have to be selected so as to leave a sufficient area for engagement on the bottom surface of the projecting member 3 surrounding the upper end of the leg 5.

As described in the foregoing, in the plastic surface fastener according to the invention since selected projecting members of one of the two surface fastener members used in combination are removed in an appropriate pattern, the projecting members of the other surface fastener member have room to escape when the projecting members of said one surface fastener member are forced between them. This makes it possible to engage the two surface fastener members with less pressing force than required heretofore.

Moreover, since the shape of the engaging heads as viewed from the top is that obtained by cutting off segments from four sides of a circle, additional room is provided for escape of the projecting members of the other surface fastener member when the projecting members of the said one surface fastener member are forced between them. This also makes it possible to engage the two surface fastener members with less pressing force than required heretofore.

Further, since considerable room for escape is secured by both removing selected projecting members in an appropriate pattern and cutting peripheral regions from the engaging heads, the two surface fastener members can be pressed into engagement more smoothly than in the prior art fastener.

What is claimed is:

1. A plastic surface fastener comprising:

first and second surface fastener members each having a plastic base and multiple projecting members having identically sized engagement heads and standing upright on the plastic base as arranged in a matrix of prescribed pitch, selected projecting members of one of said first and second surface fastener members being removed in an appropriate pattern to provide for a space for the projecting members of the other of said first and second surface fastener members to escape into when the projecting members of said one fastener member are forced into openings enclosed by the projecting members of said other fastener member;

wherein a shape of the engagement heads of the first and second surface fastener members as viewed from a top is that obtained by cutting off peripheral regions from four sides of a circle so as to provide for an increase of a size of said space.

* * * * *